US006101741A

United States Patent [19]

Sears

[11] Patent Number: 6,101,741

[45] Date of Patent: Aug. 15, 2000

[54] GRAVITY ASSISTED LINT TRAP

[75] Inventor: Jeffrey L. Sears, Grinnell, Iowa

[73] Assignee: Maytag Corporation, Newton, Iowa

[21] Appl. No.: 09/060,574

[22] Filed: Apr. 15, 1998

[51] Int. Cl.[7] ..... F26B 19/00

[52] U.S. Cl. ..... 34/417; 34/82; 34/237

[58] Field of Search ..... 34/82, 92, 380, 34/417, 444, 452, 231, 237

[56] References Cited

U.S. PATENT DOCUMENTS

| | | | |
|---|---|---|---|
| 2,509,300 | 5/1950 | Hendrickson | 183/52 |
| 2,795,055 | 5/1957 | Huebsch | 34/82 |
| 5,042,170 | 8/1991 | Hauch et al. . | |
| 5,067,253 | 11/1991 | Hauch et al. . | |
| 5,236,478 | 8/1993 | Lewis et al. | 55/319 |
| 5,560,120 | 10/1996 | Swanson et al. . | |
| 5,651,188 | 7/1997 | Swanson et al. . | |
| 5,664,339 | 9/1997 | Swanson et al. . | |

*Primary Examiner*—Henry Bennett
*Assistant Examiner*—Alein Cadalso
*Attorney, Agent, or Firm*—Zarley, McKee, Thomite, Voorhees & Sease

[57] ABSTRACT

A gravity assisted lint trap includes a housing having an inlet port formed in a lower portion and an exhaust port formed in an upper portion thereof. A lint collection screen extends within the housing to separate the ports so that air flowing from the inlet port to the exhaust port passes through the screen and deposits lint thereon. The screen is oriented in a non-vertical position within the housing, and located above lint collector, such that lint collecting on the screen will drop by gravity into the lint collector, for selective removal.

17 Claims, 4 Drawing Sheets

GRAVITY ASSISTED LINT TRAP

BACKGROUND OF THE INVENTION

The present invention relates generally to lint filtration apparatus, and more particularly to a lint collection apparatus for a domestic or commercial dryer which uses gravity to assist in self-cleaning.

The conventional household dryer has many common features among the various manufacturers. One common feature which is also a common problem among household dryers is the lint collection system.

In general, the dryer will include a screen upon which lint is collected as exhaust air from the dryer exits the drying drum. The screen has a mesh size which collects lint as the exhaust air passes through the screen. Typically, the user must periodically remove the lint from the lint screen, in order to permit continuous efficient operation of the dryer. In many cases, this lint removal operation must be performed after every dryer cycle. Because this can become a tedious task, various attempts have been made to improve the lint collection system for domestic dryers.

While various attempts have been made to improve lint collection systems, they still suffer the same common problem. Namely, once the lint screen has become filled with lint, the screen must be manually removed and "unloaded" and returned to the dryer, to continue efficient operation of the dryer.

SUMMARY OF THE INVENTION

It is therefore a general object of the present invention to provide an improved lint trap for dryers which uses gravity to assist in the removal of lint from the lint collection screen.

Another object is to provide a gravity assisted lint trap which periodically removes lint caked on a lint collection screen, without requiring manual removal of the lint by the user.

A further object of the present invention is to provide a gravity assisted lint trap which is simple to use, economical to manufacture, and efficient in operation.

These and other objects will be apparent to those skilled in the art.

The gravity assisted lint trap of the present invention includes a housing having an inlet port formed in a lower portion and an exhaust port formed in an upper portion thereof. A lint collection screen extends within the housing to separate the ports so that air flowing from the inlet port to the exhaust port passes through the screen and deposits lint thereon. The screen is oriented in a non-vertical position within the housing, and located above a lint collector such as an open topped drawer, such that lint collecting on the screen will drop by gravity into the drawer, for selective removal.

In the first embodiment of the invention, an intermediate wall is provided within the housing to divide the housing into interior upper and lower chambers. The intermediate wall has an opening therethrough and the collection screen is pivotally mounted to the intermediate wall along one edge. The screen is pivotal between a horizontal "rest" position and a non-horizontal position covering the opening in the intermediate wall. As lint collects on the screen, pressure builds under the screen so as to raise the screen upwardly against the intermediate wall. Once the dryer cycle has been completed, and the air flow stops, gravity will cause the screen to drop and sharply contact a stop flange, to knock lint from the screen.

In the second embodiment of the invention, a throat is formed in the housing between the inlet port and the screen, to direct the flow of air from the inlet port towards an edge of the screen. The air flow is directed at a generally tangential or acute angle relative to the edge of the screen so as to impart a shearing force on lint collecting on the screen, to thereby "peel" the lint from the screen.

DESCRIPTION OF THE PREFERRED EMBODIMENT

Figure 1:
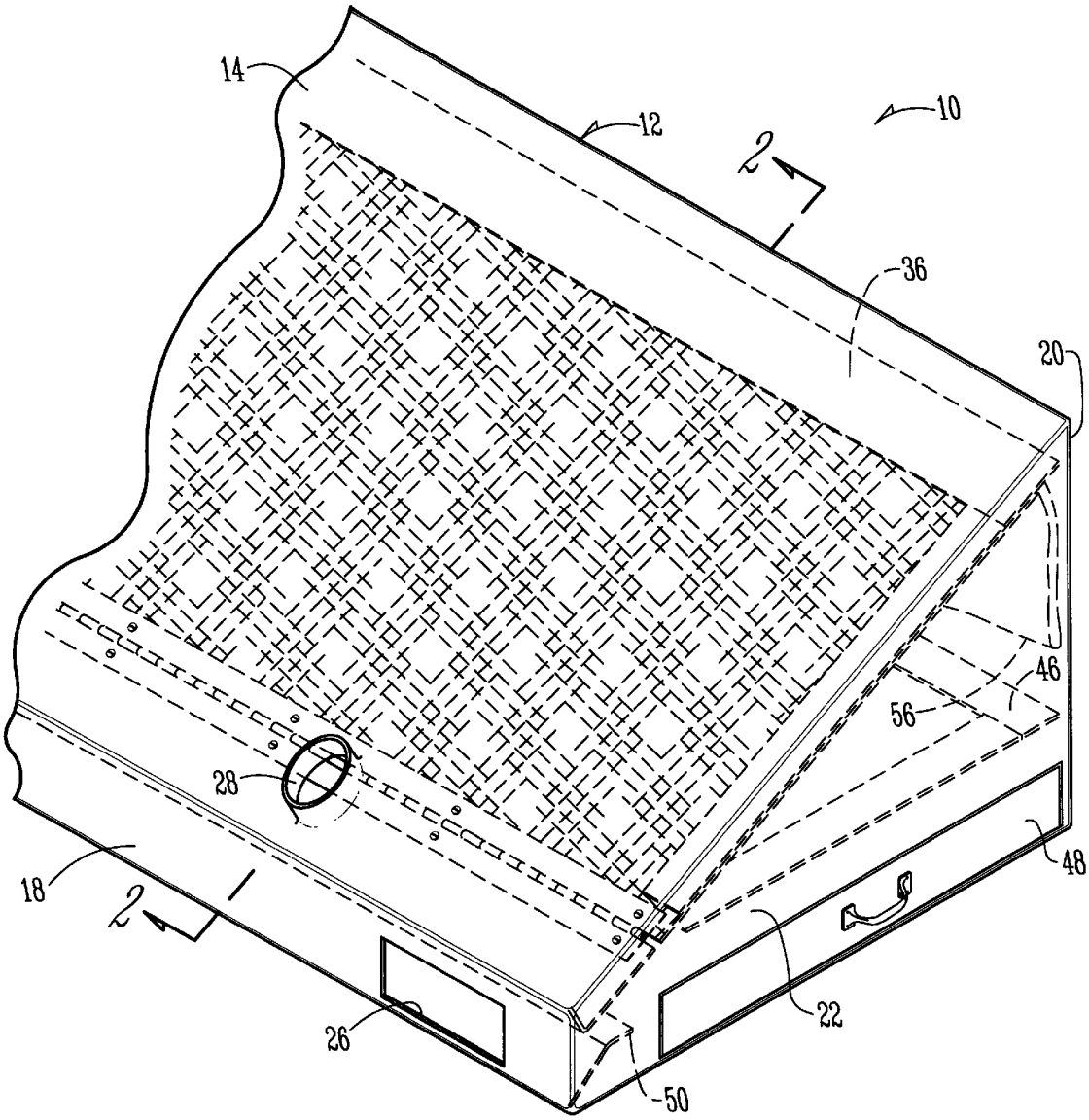
FIG. 1 is a perspective view of a first embodiment of the gravity assisted lint trap of the present invention.

Referring now to the drawings, in which similar or corresponding parts are identified with the same reference numeral, and more particularly to FIG. 1, the gravity assisted lint trap of the present invention is designated generally at 10 and includes a housing 12 having a sloped upper wall 14, a generally horizontal bottom wall 16, forward and rearward walls 18 and 20, and opposing end walls 22 and 24. An intake opening 26 is formed in forward wall 18 for directing lint-entrained air from the clothes dryer into trap 10. An exhaust opening 28 is formed in upper wall 14, for exhausting filtered air from trap 10 to the atmosphere.

Figure 2:
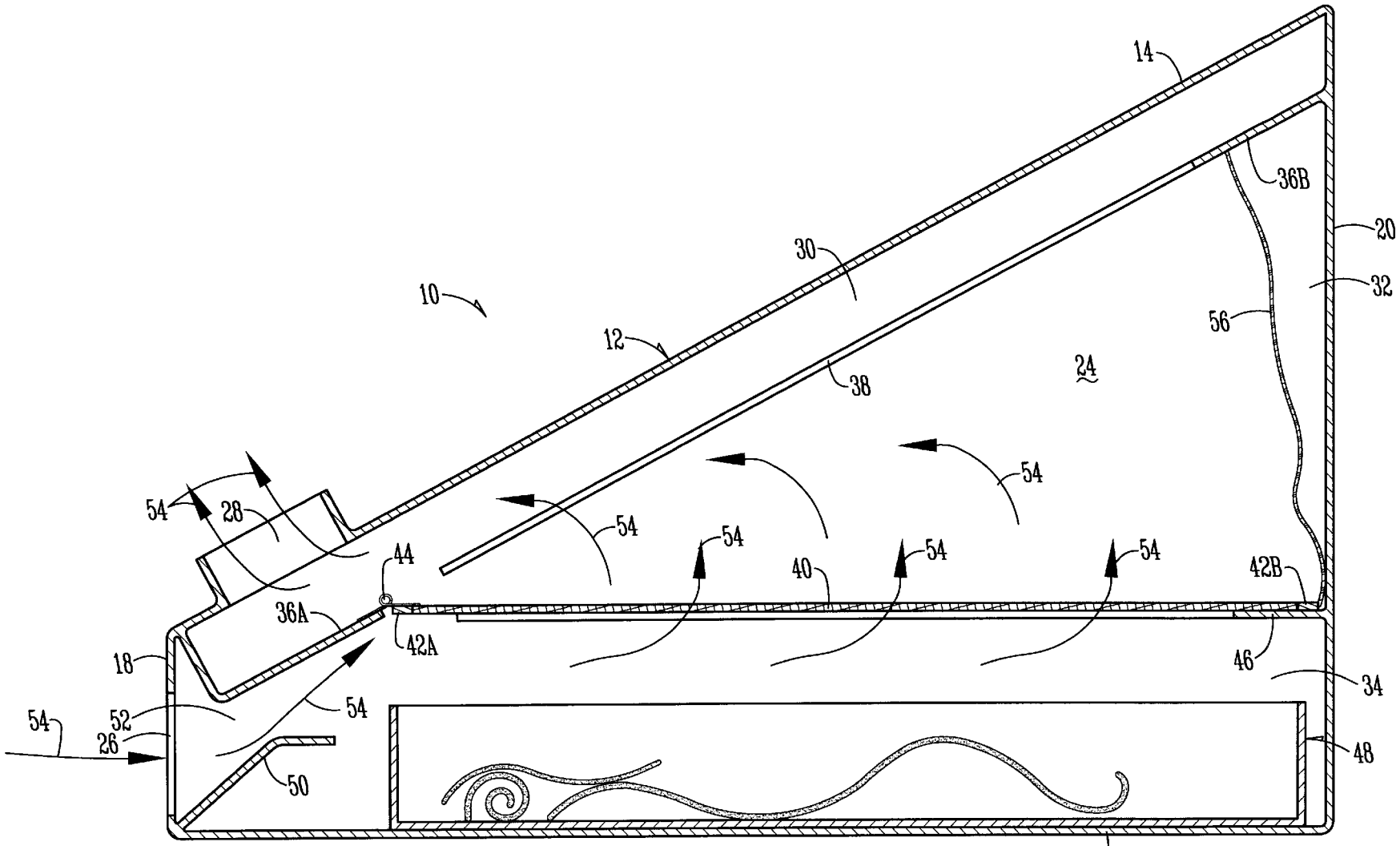
FIG. 2 is a sectional view taken at lines 2—2 in FIG. 1, with the lint collection screen shown in an "unloaded" condition.
Figure 3:
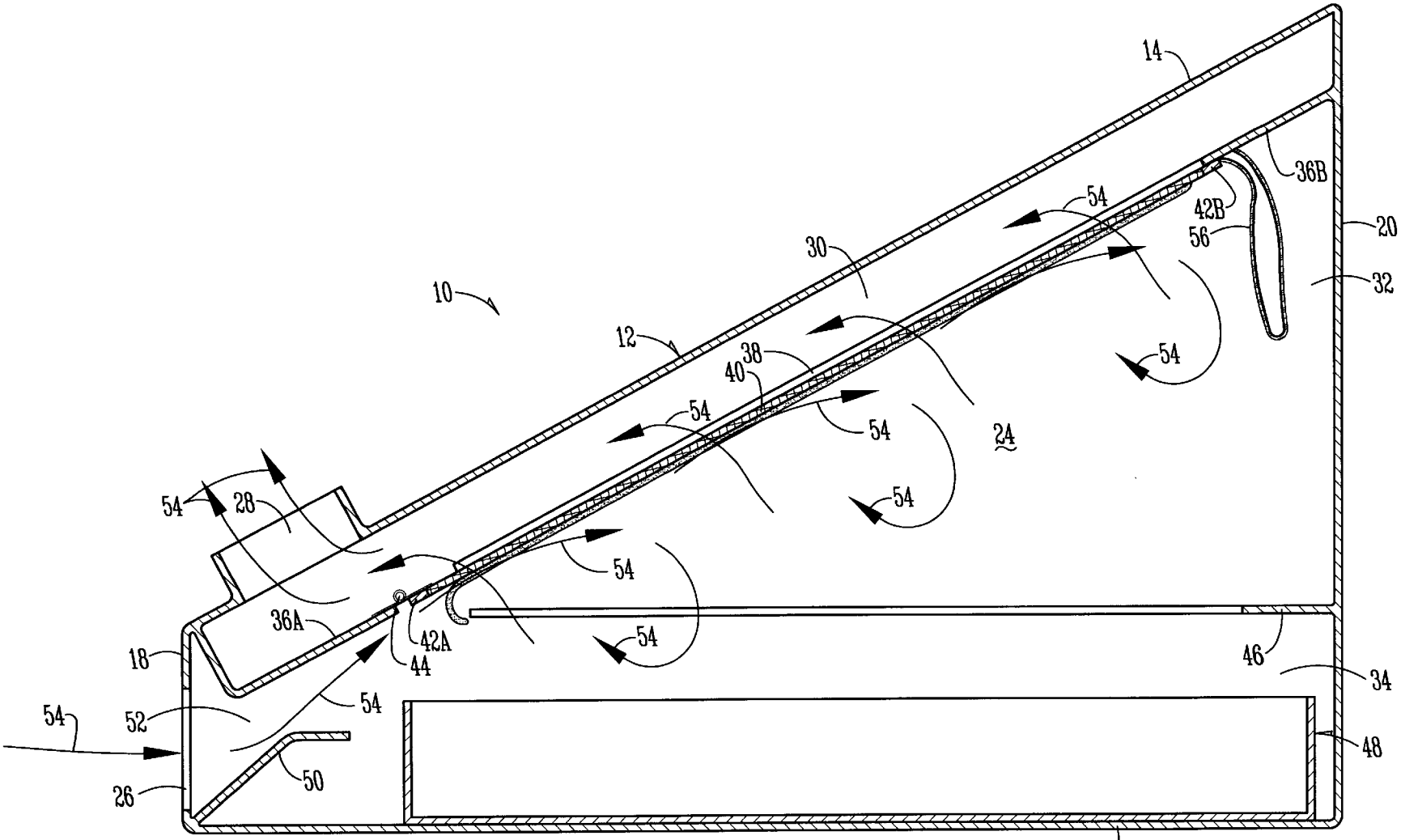
FIG. 3 is a sectional view similar to FIG. 2, with the lint collection screen shown in a "loaded" condition.

Referring now to FIGS. 2 and 3, it can be seen that the interior cavity of housing 12 is generally divided into three chambers: (1) an exhaust chamber 30, (2) a filter chamber 32, and (3) a collection chamber 34. Exhaust chamber 30 extends downwardly from upper wall 14 to an intermediate wall 36, from end to end, and forward wall to rearward wall. A large opening 38 is formed in intermediate wall 36 to permit air flow from filter chamber 32 into exhaust chamber 30.

A screen 40 is secured within a frame 42, and has dimensions to completely cover opening 38, extending generally from end to end within housing 12. A forward edge 42*a* of screen frame 42 is pivotally connected along its length to intermediate wall 36 along the forward edge of opening 38. Thus, screen 40 and frame 42 will pivot about hinge 44 from a non-horizontal upper position shown in FIG. 3 to a generally horizontal "rest" position shown in FIG. 2, spaced away from intermediate wall 36. A projecting flange 46 extending forwardly from rearward wall 20, and spaced below intermediate wall 36, acts as a support or "stop" for screen 40 in the "rest" position. Preferably, flange 46 is located such that screen 40 is oriented generally horizontally when in the "rest" position.

Filter chamber 32 extends from intermediate wall 36, down to flange 46, within housing 12. Collection chamber 34 is located below filter chamber 32, and has a drawer 48 slidably mounted therein, to collect lint from screen 40, as described in more detail hereinbelow.

A deflection plate 50 extends between the ends of housing 12 and projects upwardly and rearwardly from the lower edge of forward wall 18. Deflection plate 50 deflects air flow entering through inlet opening 26 upwardly over the upper edge of drawer 48 through a throat 52 formed between deflection plate 50 and the lower forward portion 36*a* of intermediate wall 36. Throat 52 is designed to direct air flow from inlet opening 26 at an acute angle relative to screen 40. As shown by arrows 54 in FIGS. 2 and 3, air flow enters through inlet opening 26, is then directed rearwardly by throat 52, into collection chamber 34, and thence upwardly through screen 40 through exhaust chamber 30 and out through exhaust opening 28.

As lint begins to collect on the lower surface of screen 40, air flow through screen 40 will be restricted, thereby increasing the air pressure within collection chamber 34, as well as increasing the surface area contacted by the air flow on the lower surface of screen 40. This in turn will cause screen 40 to pivot upwardly on hinge 44, from the rest position shown in FIG. 2, until the screen frame contacts intermediate wall 36, as shown in FIG. 3, where lint will continue to build and thicken on screen 40.

When the dryer is turned off, air flow will cease, and the screen 40 will drop by virtue of gravity and hit the flange 46. The sharp contact of screen 40 with flange 46 will cause the lint build-up on the screen to be knocked off and dropped into drawer 48.

A bellows type flexible lint seal 56 has one edge connected along the length of the rearward edge 42*b* of screen frame 42 and the opposing edge attached along the rearward portion 36*b* of intermediate wall 36, to prevent lint-entrained air flow around the rearward edge of screen 40, which would thereby bypass screen 40. To ensure that air flow does not bypass screen 40, the lint seal 56 also extends along the sides of the screen frame 42.

Figure 4:
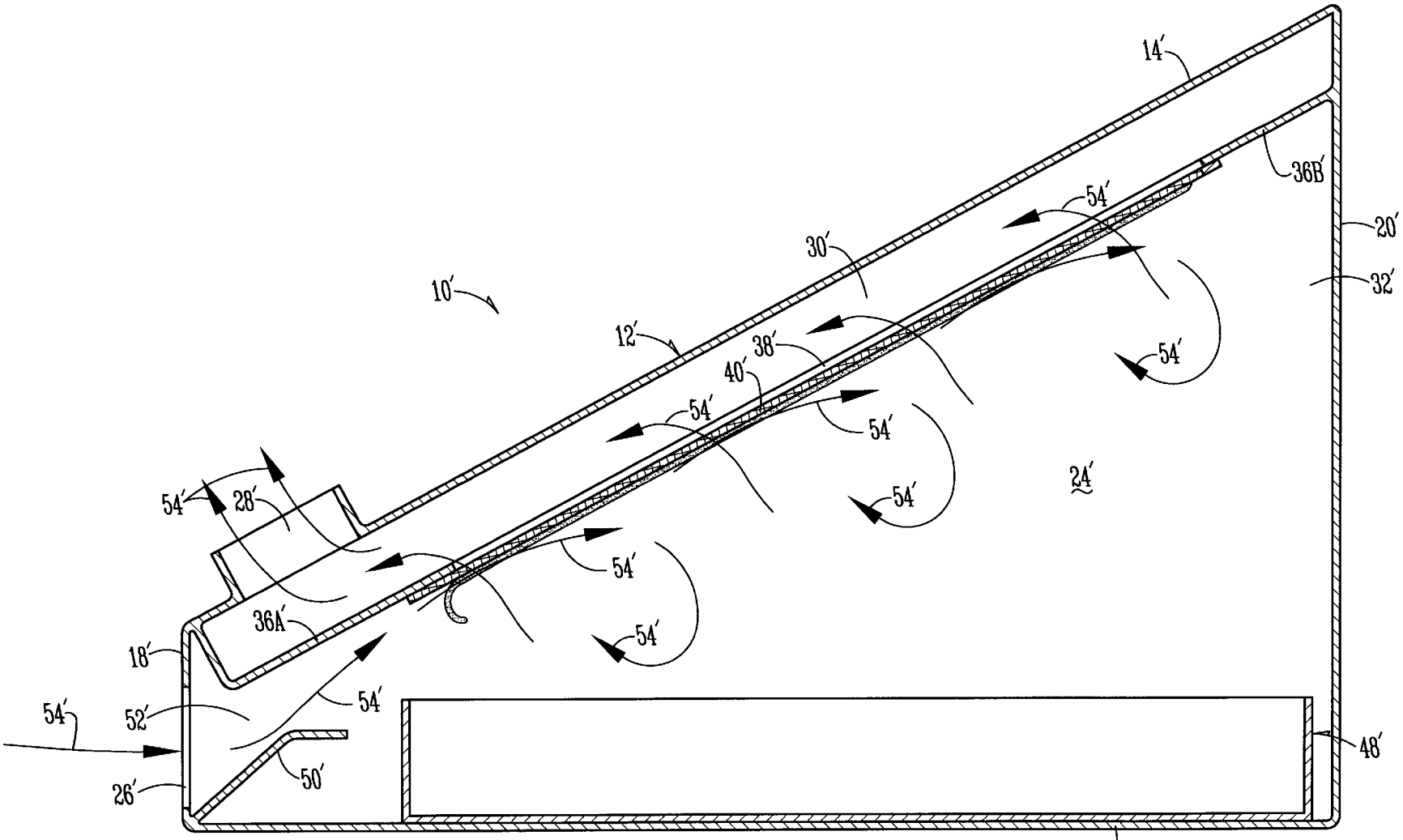
FIG. 4 is a sectional view similar to FIG. 2, but showing a second embodiment of the invention.

Referring now to FIG. 4, a second embodiment of the lint trap is designated generally at 10', and uses the same housing 12' of the first embodiment of the invention. The major difference between the first and second embodiments is the use of a screen 40' which is fixed in position over opening 38' in intermediate wall 36'. Air flow through inlet opening 26' is directed by throat 52' so as to impinge on screen 40' along the forward edge 40'*a* thereof at an acute angle, or tangent to screen 40'. In this way, the air flow will shear the lint off of the mesh and induce separation of the lint cake from the mesh.

Whereas the invention has been shown and described in connection with the preferred embodiments thereof, many modifications, substitutions and additions may be made which are within the intended broad scope of the appended claims.

I claim:

1. A gravity assisted lint trap, comprising:

an enclosed housing having an inlet port and an exhaust port;

an intermediate wall within the housing and dividing the housing into upper and lower chambers, said intermediate wall having an opening therethrough;

a lint collection screen extending within the housing and separating the inlet port from the exhaust port, such that air flowing into the housing from the inlet port must pass through the screen before exiting through the exhaust port;

said lint collection screen being pivotally mounted to said housing for pivotal movement between a first generally horizontal rest position and a second non-horizontal position covering the opening in the intermediate wall; and a lint collector operably mounted within the housing for selective removal therefrom, the lint collector extending under the entirety of the screen to receive lint dropping by gravity from the screen.

2. The lint trap of claim 1, further comprising a throat formed within the housing and extending from the inlet port, directing air flow from the inlet port towards an edge of the screen such that the air flow imparts a shearing force on lint collecting on the screen.

3. The lint trap of claim 2, wherein the throat directs air flow above the lint collector.

4. The lint trap of claim 1, further comprising a flange projecting within the housing to prevent pivotal movement of the screen downwardly beyond the "rest" position.

5. The lint trap of claim 1, further comprising seal means connected between an edge of the screen and the intermediate wall, for preventing air flow around the edge of the screen.

6. A gravity assisted lint filter for a laundry dryer of the type having an air exhaust line for exhausting lint-entrained air from the dryer, comprising:

an enclosed housing having an inlet port connected to the dryer air exhaust line;

said inlet port formed in a lower portion of the housing and said housing including an exhaust port formed in an upper portion of the housing;

an intermediate wall within the housing and dividing the housing into upper and lower chambers, said intermediate wall having an opening therethrough;

a lint collection screen extending within the housing and separating the inlet port from the exhaust port, such that air flowing into the housing from the inlet port must pass through the screen before exiting through the exhaust port;

said lint collection screen being pivotally mounted to said housing for pivotal movement between a first generally horizontal rest position and a second non-horizontal position covering the opening in the intermediate wall; and a lint collector operably mounted within the housing for selective removal therefrom, the lint collector extending under the entirety of the screen to receive lint dropping by gravity from the screen.

7. The lint trap of claim 6, further comprising a throat formed within the housing and extending from the inlet port, directing air flow from the inlet port towards an edge of the screen such that the air flow imparts a shearing force on lint collecting on the screen.

8. The lint trap of claim 7, wherein the throat directs air flow above the lint collector.

9. The lint trap of claim 6, further comprising a flange projecting within the housing to prevent pivotal movement of the screen downwardly beyond the "rest" position.

10. The lint trap of claim 6, further comprising seal means connected between an edge of the screen and the intermediate wall, for preventing air flow around the edge of the screen.

11. In combination:

a laundry dryer exhaust line for exhausting lint-entrained air from a dryer; and a gravity assisted lint trap connected to the exhaust line, said lint trap including:

an enclosed housing having an inlet port connected to the dryer air exhaust line;

said inlet port formed in a lower portion of the housing and said housing including an exhaust port formed in an upper portion of the housing;

an intermediate wall within the housing and dividing the housing into upper and lower chambers, said intermediate wall having an opening therethrough;

a lint collection screen extending within the housing and separating the inlet port from the exhaust port, such that air flowing into the housing from the inlet port must pass through the screen before exiting through the exhaust port;

said lint collection screen being pivotally mounted to said housing for pivotal movement between a first generally horizontal rest position and a second non horizontal position covering the opening in the intermediate wall; and an open topped drawer operably mounted within the housing for selective removal therefrom, the drawer extending under the entirety of the screen to receive lint dropping by gravity from the screen.

12. The combination of claim 11, further comprising a throat formed within the housing and extending from the inlet port, directing air flow from the inlet port towards an edge of the screen such that the air flow imparts a shearing force on lint collecting on the screen.

13. The combination of claim 12, wherein the throat directs air flow above the drawer.

14. The combination of claim 11, further comprising a flange projecting within the housing to prevent pivotal movement of the screen downwardly beyond the "rest" position.

15. The combination of claim 11, further comprising seal means connected between an edge of the screen and the intermediate wall, for preventing air flow around the edge of the screen.

16. A method for removing lint from the exhaust line of a laundry dryer, comprising the steps of:

providing a lint trap having an inlet port, an outlet port, and a lint collection screen separating the inlet and outlet ports;

introducing lint-entrained air into the inlet port;

pivoting the lint collection screen from a first generally horizontal position at rest above the inlet port and below the outlet port to a second non-vertical position above the inlet port and between the inlet port and the outlet port;

positioning an open topped drawer under the screen; and collecting lint in the drawer, which drops from the screen.

17. The method of claim 16, further comprising the step of directing air flow from the inlet port to an edge of the screen at an angle which imparts a shearing force on lint collecting on the screen.

* * * * *